US006403543B1

(12) United States Patent
George

(10) Patent No.: US 6,403,543 B1
(45) Date of Patent: Jun. 11, 2002

(54) SOAP WITH SUSPENDED ARTICLES

(75) Inventor: Edmund D. George, Warwick, RI (US)

(73) Assignee: Original Bradford Soap Works, Inc., W. Warwick, RI (US)

( * ) Notice: Subject to any disclaimer, the term of this patent is extended or adjusted under 35 U.S.C. 154(b) by 0 days.

(21) Appl. No.: 09/572,679

(22) Filed: May 16, 2000

(51) Int. Cl.[7] ..... C11D 17/00; C11D 17/04; C11D 9/00

(52) U.S. Cl. ..... 510/147; 510/143; 510/440; 510/483

(58) Field of Search ..... 510/147, 143, 510/440, 483

(56) References Cited

U.S. PATENT DOCUMENTS 5,141,664 A * 8/1992 Corring et al. ..... 252/90
5,427,708 A * 6/1995 Stark ..... 252/108
5,817,609 A * 10/1998 He et al. ..... 510/133
5,869,437 A * 2/1999 Wolfersberger et al. .... 510/147
6,090,763 A * 7/2000 Stewart et al. ..... 510/130
6,107,262 A * 8/2000 Noble ..... 510/147

* cited by examiner

*Primary Examiner*—Yogendra N. Gupta
*Assistant Examiner*—John M. Petruncio
(74) *Attorney, Agent, or Firm*—Dike, Bronstein, Roberts & Cushman, Intellectual Property Practice Group of; Edwards & Angell, LLP

(57) ABSTRACT

A soap bar with suspended articles dispersed in a random manner throughout the bar. The articles may contain various skin conditioning, fragrance, or other aesthetic elements that are appealing to the consumer. The process for making the disclosed soap bar is also disclosed. The process comprises forming a gel matrix into which the articles are suspended before being added to the primary soap mixture. The gel matrix of the present invention is formed with a suspending agent which is particularly advantageous when used in the present invention.

15 Claims, 1 Drawing Sheet

SOAP WITH SUSPENDED ARTICLES

FIELD OF THE INVENTION

The present invention is directed to a soap bar with suspended articles and a process for making the same. The soap of the invention comprises a bar soap containing suspended articles which are enveloped by the primary soap and randomly distributed throughout the bar. The process for making the soap includes a cost effective method of ensuring the beads distribute evenly throughout the bar and remain suspended within the primary soap without appreciable floating or sinking of the beads.

BACKGROUND OF THE INVENTION

The consumer market for bar soap is an extraordinary large market. The variety of bar soaps available to the consumer is similarly large giving the consumer a multitude of choices and rendering the marketing of soap an important part of the soap business. Because of the competition in this lucrative market, any advantage which may attract and keep the consumer's attention will likely influence the consumer's buying decision and result in a competitive advantage for the manufacturer. Conversely, any modification made to the soap bar for marketing purposes must be inexpensive since the soap market is highly price sensitive.

In order to distinguish their product and attract the consumer's attention, companies have used both functional and aesthetic characteristics to attract and hold the consumer's attention. Aesthetic characteristics including colors, patterns and shapes are well known to the art. Likewise, functional characteristics such as skin conditioners and fragrances and exfoliants have been widely used.

U.S. Pat. No. 5,869,437, to Wolferberger, teaches one method of appealing to the consumer's aesthetic testes. The Wolferberger patent teaches the suspension of a dissolvable label or logo in a bar of transparent soap through a two stage manufacturing process. In the first stage, half of the transparent soap is poured into a mold and allowed to solidify. In the second stage a label is applied to the upper surface of the first stage bar and an additional second layer of soap is poured on top of the first soap stage to encapsulate the label. This method produces a soap bar in which the label is completely encapsulated within the soap but does not easily adapt to encapsulating a plurality of objects since the number of stages needed to evenly or randomly encapsulate a plurality of objects would unreasonably to prolong the manufacturing process and increase the cost accordingly.

Another method of appealing to consumers is to add a functional characteristic that appeals to consumers. Many of the soaps which have a conditioning effect do so by mixing a skin conditioner into the primary soap. Several soap brands have further promoted transparent soap as being free from additives that may otherwise cause skin irritations or acne. While several brands of soap have sought to distinguish themselves through the use of fragrances to impart a "fresh" or "clean" smell after use.

All of these methods appeal to the consumer, however, a soap bar that includes visually appealing elements in addition to functional characteristics would be especially effective in attracting and retaining the consumers attention and thus would likely result in higher sales.

SUMMARY OF THE INVENTION

The present invention is directed to a soap bar with suspended articles randomly dispersed throughout the bar.

The articles may comprise various cosmetic or aesthetic features that appeal to consumers. Also described is a process for making the soap bars.

BRIEF DESCRIPTION OF THE DRAWINGS

Reference is next made to a brief description of the drawings, which are intended to illustrate the present invention. The drawings and detailed description which follow are intended to illustrate embodiments of the invention as set forth in the appended claims.

DESCRIPTION OF THE PREFERRED EMBODIMENTS

Figure 1:
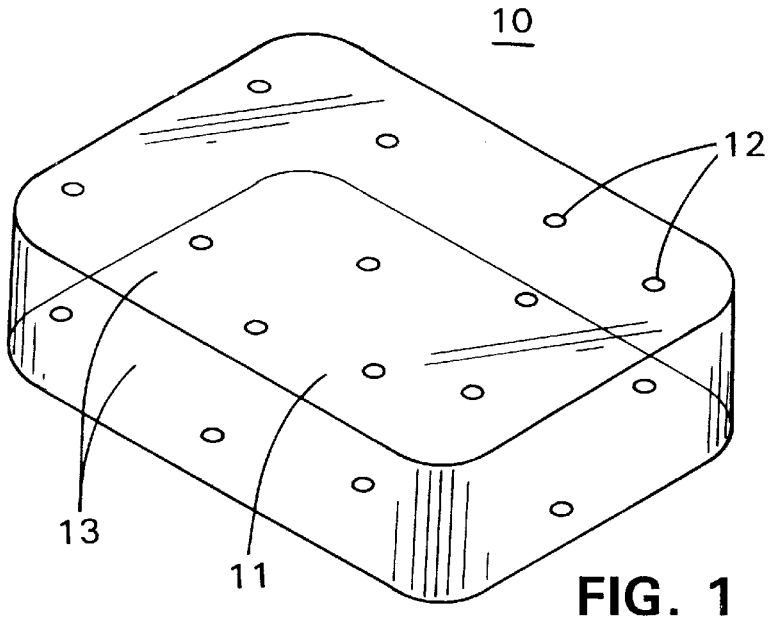
FIG. 1 shows a perspective view of a soap bar of the present invention made with transparent soap.

Referring to FIG. 1, the soap bar 10 of the present invention is shown. The primary soap 11 is shown encapsulating a plurality of suspended articles 12. The articles are preferably suspended within the primary soap 11 but may optionally be positioned such that the articles 12 are in contact with an outer surface 13 of the soap bar 10. It is most preferred that the articles 12 be distributed evenly throughout the entire soap bar 10. For the purposes of this invention, transparent soap is used to ensure the articles are visible to the user. It is understood in the art that transparent soap includes those soaps that have varying degrees of visual clarity, for example, visually translucent and colored soap are generally considered transparent by those in the art.

Figure 2:
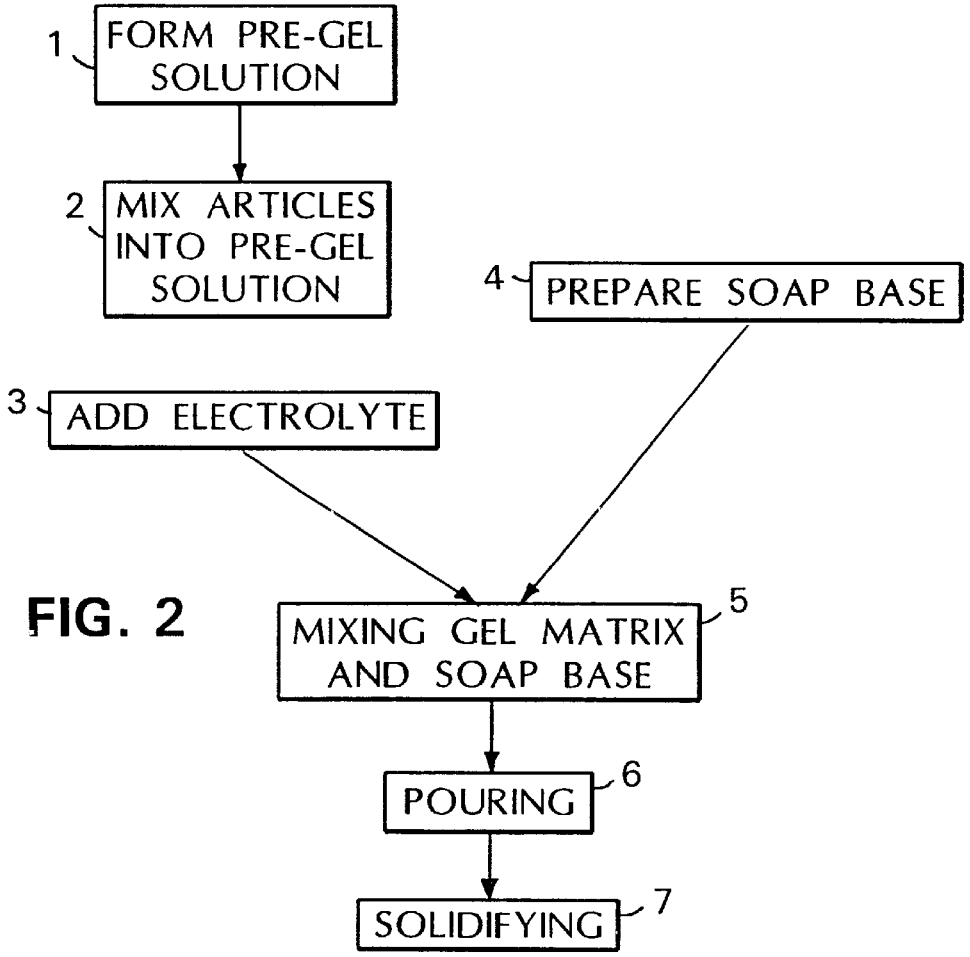
FIG. 2 shows a flow chart describing the process of the present invention.

FIG. 2 shows a process flow diagram describing an embodiment of the process of the present invention. In Step 1, the pre-gel mixture that will suspend the beads is formed. Preferably, the pre-gel is formed by mixing a glycol with water and adding a suspending agent in such a way that clumping of the agent is avoided. The preferred method is by stirring, but any method which mixes the suspending agent until it is completely hydrated is acceptable. Propylene glycol is a preferred glycol because it is non-toxic, but other suitable glycols may be used as well. The suspending agent may be any thickening agent but is preferably one that increases the viscosity of the solution as an electrolyte is added. Most preferably, the suspending agent is a synthetic or natural mineral hectorite. Synthetic hectorite, LAPONITE XLG, manufactured by Laporte Absorbants of Widnes, United Kingdom has been found to work exceptionally well for the purposes of the invention. Hectorite is characterized chemically as hydrous sodium lithium magnesium 1w silicate. The preferred proportions of the pre-gel components, by weight, include between about 45% and 60% water, between about 15% and 35% glycol, and between about 1.5% and flat 3.0% suspending agent.

Step 2 describes the addition of articles to the pre-gel solution. The articles should be free from any sediment, salt, or other contaminant to ensure they are coated completely by the gel matrix when mixed into the gel. The articles are preferably evenly dispersed throughout the pre-gel solution in a random pattern. The pre-gel solution is relatively basic, for example over pH 8.

Step 3 describes the addition of the electrolyte to the pre-gel solution to form the gel matrix. The addition of the electrolyte thickens solution, forming the gel matrix which will suspend the articles. It is believed that the addition of the electrolyte decreases the electrostatic repulsion between the hectorite platelets resulting in a thicker more viscous solution.

Step 4 describes the formation of the soap base. The soap base is preferably transparent which is understood in the art to include visually translucent soap bases as well. Transparent soap bases are preferred because the suspended article will then be visible to the user and because the softer transparent soap is less likely to rupture any encapsulated article.

Step 5 describes the mixing of a sufficient amount of the gel matrix with the soap base. Preferably the mixing is performed by a stirring apparatus. It has been found that when using articles comprising encapsulated or microencapsulated materials, a lower shear rate is desirable to avoid rupturing the encapsulated materials. Because the composition and resiliency of the encapsulating material may vary widely, the stirring rate must be determined according to the individual characteristics of the articles to ensure the articles do not rupture and that they are distributed throughout the mixture.

Step 6 describes the pouring process in which the soap mixture is poured into molds that will give the soap bars the individual bar shape. The pouring process is preferably done at elevated temperatures to prevent the soap from solidifying before it poured into the molds. The preferred temperature is between about 120° F. to about 150° F. with a most preferred range of about 125° F. to about 135° F.

Step 7 describes the solidifying step in which the poured soap mixture is solidified to form its final shape. The preferred method of solidifying is cooling the poured bars by exposing them to cooled air. This may be done in a batch process or on a continuous conveyor belt in a cooling chamber. Typically, the final shape of the bar is determined by the shape of the mold, however, billets may also be formed, which may later be cut into individual bars.

While the actual mechanism that enables the suspension is not known, it is believed that the hectorite, which is composed of mineral platelets, evenly disperses in water due to forces of electrostatic repulsion producing a thickening effect which suspends articles. It has been found that when an electrolyte, such as sodium hydroxide, is added to the mixture, the repulsion between the platelets is reduced and a thickening effect is observed, resulting in a thick but clear aqueous gel. We have found that the above suspension technique is particularly advantageous for the basic pre-gel solutions at issue here.

In a preferred embodiment, the articles are comprised of an encapsulated or microencapsulated material comprising a shell wall and an encapsulated material. The encapsulated material is preferably a hydrophobic oil-based material such as jojoba oil, shea butter, sweet almond oil, avocado oil, sunflower oil, mineral oil, sesame oil, wheat germ oil, tee tree oil, petrolatum, fatty acids, triglycerides, silicones, fragrances, essential oil, triclocarban, triclosan, salicylic acid, isoprpyl myristate, isoproply palmitate, C12–15 alkyl benzoate skin conditioning emollient, butyl myristate, Vitamin C, Vitamin A, Vitamin $B_5$, Vitamin E, including their esters and derivatives, oil soluble pigments, or oil dispersible powders, such as titanium dioxide, bismuthoxychloride, or any other hydrophobic material may be used.

The nature of the invention is such that the shell wall must contain the encapsulated material within the soap and must release the encapsulated material when physically ruptured or when dissolved in water. The shell wall must also be resilient to the basic soap base and yet be impervious to oil based encapsulated material. It has been found that several materials may be used to form suitable shell walls. Preferred materials include Agar, a colloidal polygalactoside, or gelatin, Algin or an alginate polymer blend. There are several commercially prepared beads which work equally well including LIPOSPHERE beads from Lipo Technologies, Inc. of Vandalia, Ohio. The beads may range in diameter from 5 to 2500 microns with a most preferred diameter of 1300 to 1600 microns.

The beads may be optionally colored to provide a more attractive appearance. The preferred colors include certified D&C Lakes and Dyes, certified FD&C Lakes and Dyes, chromium hydroxide, iron oxide, mica, titanium dioxide, and ultramarine blue. One skilled in the art will readily appreciate that the soap base of the present invention may be visually transparent or translucent.

These examples are offered to illustrate preferred embodiments of the invention and not by way of limitation. It will be readily apparent to those skilled in the art that other variation of the product and process are possible which fall within the scope of the appended claims.

What is claimed is:

1. A solid soap bar comprising:

a transparent primary soap base; and a plurality of bead articles containing an encapsulated material suspended by a pre-gel mixture in a the primary soap base.

2. The soap of claim 1, wherein the articles are randomly dispersed throughout the soap.

3. The soap of claim 2, wherein the encapsulated material is selected from the group consisting of jojoba oil, shea butter, sweet almond oil, avocado oil, sunflower oil, mineral oil, sesame oil, wheat germ oil, tee tree oil, petrolatum, fatty acids, triglycerides, silicones, fragrances, essential oil, triclocarban, triclosan, salicylic acid, isopropyl myristate, isopropyl palmitate, C12–15 alkyl benzoate skin conditioning emollient, butyl myristate, Vitamin C, Vitamin A, Vitamin $B_5$, Vitamin E, oil soluble pigments, and oil dispersible powders.

4. The soap bar of claim 1, wherein the primary soap base is translucent.

5. The soap bar of claim 1, wherein the encapsulated material is micro-encapsulated.

6. The soap bar of claim 1, wherein the soap bar pH is 8.0 or above.

7. The soap bar of claim 1 or claim 6, wherein the shell of the encapsulated material is stable under conditions of the soap bar, thereby avoiding unacceptable degradation of the encapsulated material before use.

8. The process of forming a suspended bead article soap bar according to claim 1 comprising the steps of:

preparing a gel matrix containing a plurality of articles;

preparing a transparent soap base;

mixing a sufficient amount of the gel matrix with the soap base to form a mixture; and solidifying the mixture.

9. The process of forming a gel matrix for suspending bead articles in a soap base according to claim 8 comprising:

forming a pre-gel solution;

adding bead articles to the pre-gel solution; and adding an electrolyte to the pre-gel solution.

10. The process of claim 9, wherein the pre-gel solution is a mixture of water, a suitable glycol, and a suspending agent.

11. The process of claim 9, wherein the electrolyte has a pH greater than 7.0.

12. The process of claim 9 wherein the electrolyte is sodium hydroxide.

13. The process of claim 10, wherein the suspending agent is a natural hectorite material.

14. The process of claim 10, wherein the suspending agent is a synthetic hectorite.

15. The process of claim 9, wherein the pre-gel solution comprises between about 45% and about 60% water, between about 15% and 35% glycol, and between about 1.5% and 3.0% suspending agent.

* * * * *

UNITED STATES PATENT AND TRADEMARK OFFICE

CERTIFICATE OF CORRECTION

PATENT NO. : 6,403,543 B1
DATED : June 11, 2002
INVENTOR(S) : Edmund D. George

It is certified that error appears in the above-identified patent and that said Letters Patent is hereby corrected as shown below:

Title page,
Item [73], replace "Original Bradford Soap Works, Inc., W. Warwick, RI (US)" with -- The Original Bradford Soap Works, Inc., W. Warwick, RI (US) --;

Column 1,
Line 35, replace "testes" with -- tastes --; and

Column 3,
Line 56, replace "tee" with -- tea --.

Signed and Sealed this

Fourteenth Day of January, 2003

JAMES E. ROGAN
*Director of the United States Patent and Trademark Office*